US005398450A

United States Patent [19]

Cacicedo

[11] Patent Number: 5,398,450

[45] Date of Patent: Mar. 21, 1995

[54] SPRING GATE

[76] Inventor: Paulino A. Cacicedo, 5 Tisbury Ct., Scotch Plains, N.J. 07076

[21] Appl. No.: 278,901

[22] Filed: Jul. 22, 1994

[51] Int. Cl.[6] ..... E05F 1/10; E05D 7/00

[52] U.S. Cl. ..... 49/386; 49/385

[58] Field of Search ..... 49/386, 385

[56] References Cited

U.S. PATENT DOCUMENTS

| | | | |
|---|---|---|---|
| 4,270,312 | 6/1981 | Courtis et al. | 49/386 X |
| 4,381,626 | 5/1983 | Courtis et al. | 49/386 X |
| 4,470,221 | 9/1984 | Courtis | 49/386 X |
| 4,887,393 | 12/1989 | Cysewski | 49/386 X |
| 4,986,031 | 1/1991 | Agnew et al. | 49/386 X |
| 5,131,187 | 7/1992 | Agnew et al. | 49/386 X |

*Primary Examiner*—Philip C. Kannan
*Attorney, Agent, or Firm*—R. Gale Rhodes, Jr.

[57] ABSTRACT

Tension produced force is applied to a pivotally mounted gate to cause the gate to reside in a generally horizontal spring balanced position to close the gate, and/or tension produced force is applied to the gate to cause the gate to reside in a generally vertical spring balanced position to open the gate.

8 Claims, 2 Drawing Sheets

SPRING GATE

BACKGROUND OF THE INVENTION

This invention relates generally to a new and improved gate of the type generally referred to in the art as a spring gate and more particularly relates to a new and improved spring gate which is spring balanced in a generally horizontal position to close the gate and which is spring balanced in a generally vertical position to open the gate; such spring balancing of the gate permits the gate to be easily closed or opened by the application of only a small force which may be applied manually by a gate operator or gate attendant. The spring gate of the present invention may be spring balanced only in the closed position or spring balanced only in the opened position, or both.

Numerous spring gates are known to the prior art including numerous different structural features; however, there exists a need in the art for a new and improved spring gate which is relatively simple in structure and manufacture and which may be operated easily for opening and closing by the application of a relatively small force capable of being readily generated by a gate keeper or gate attendant.

SUMMARY OF THE INVENTION

The gate of the present invention is mounted pivotally and tension produced force is applied to the gate to cause the gate to reside in a generally horizontal spring balanced position to close the gate, and/or tension produced force is applied to the gate to cause the gate to reside in a generally vertical spring balanced position to open the gate.

DESCRIPTION OF THE PREFERRED EMBODIMENTS

Figure 1:
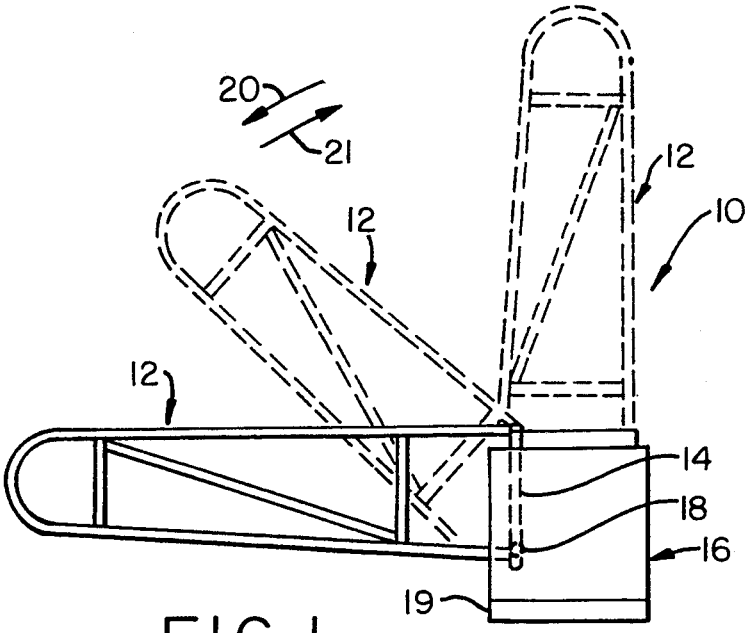
FIG. 1 is a diagrammatical illustration of the spring gate of the present invention showing the gate in solid outline in the closed position and showing the gate in dashed outline moving into and in an opened position.

Referring now to FIG. 1, spring gate apparatus embodying the present invention is illustrated diagrammatically and indicated by general numerical designation 10. Apparatus 10 includes a gate indicated by general numerical designation 12 and which gate includes a rearward portion 14 mounted pivotally to a base 16 by suitable pivot means 18; base 16 may be suitably mounted to a support such as a concrete support 19. Generally, the gate 12 is mounted pivotally for being pivoted in the forward direction, as indicated by the arrow 20, to place the gate in a generally horizontal position to close the gate and for being pivoted in the rearward direction, as indicated by arrow 21, to place the gate in a generally vertical position to open the gate.

Figure 4:
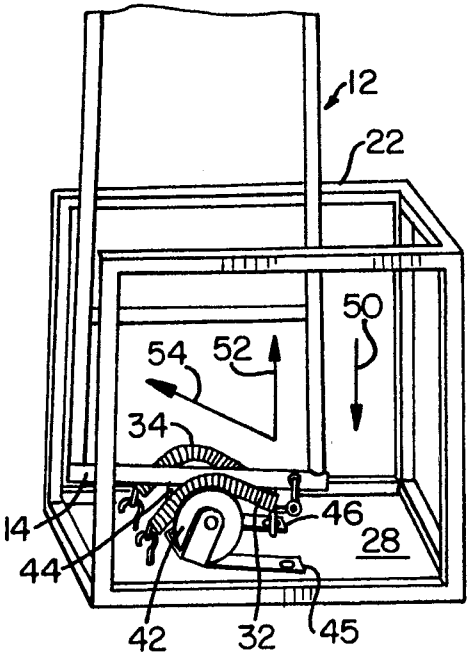
FIGS. 2, 3 and 4 are diagrammatical illustrations of a first embodiment of the present invention, the gate is shown in partial view in these FIGS., and in FIG. 2 the gate is shown in its closed position, in FIG. 3 the gate is shown being pivoted rearwardly into the opened position and in FIG. 4 the gate is shown in the opened position.
Figure 3:
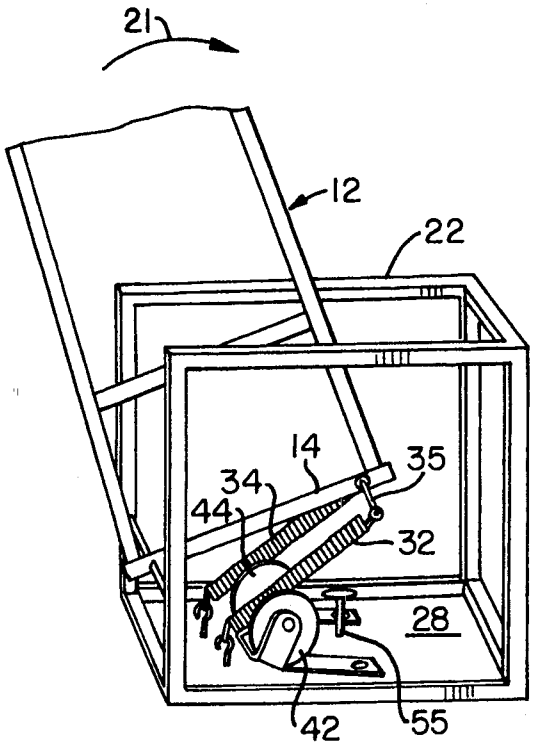
Figure 2:
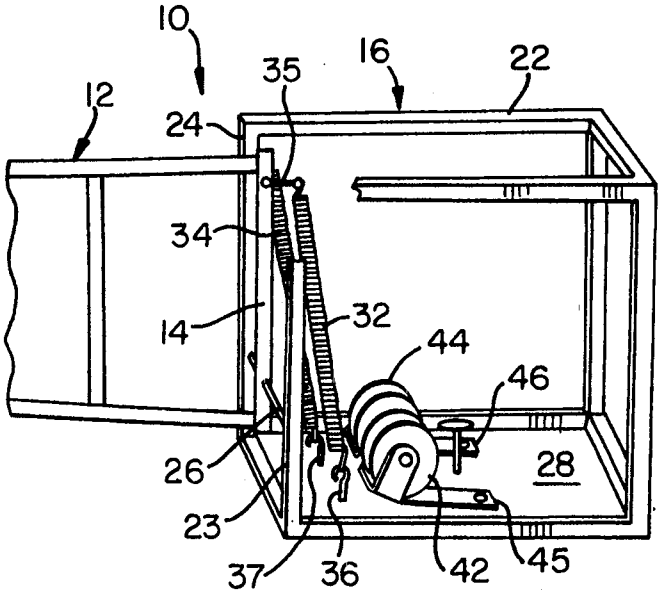

Referring now to FIGS. 2–4, the base 16 of FIG. 1 may comprise a frame 22 including a bottom member 28 and a pair of upstanding legs 23 and 24 between which a pivot rod 26 is mounted horizontally; the rearward portion 14 of the gate 12 is mounted pivotally to the pivot rod 26. The apparatus 10 may further include a pair of coiled tension springs 32 and 34 extending between the gate rearward portion 14 and the frame bottom 28 with the top portions of the springs mounted to the rearward gate portion 14 by a mounting rod 35 and with the bottom portions of the springs being mounted to the bottom 28 by suitable spring mounting members 36 and 37. Also mounted to the frame bottom 28 are a pair of rollers 42 and 44 which rollers may be suitably mounted to the frame bottom 28 by suitable leaf spring members 45 and 46; the leaf spring members 45 and 46 may be suitably mounted to the frame bottom 28 such as by bolts or other threaded members as illustrated diagrammatically in FIGS. 2–4.

Upon the gate 12 being pivoted in the rearward direction as indicated by the arrow 21 in FIG. 3, the springs 32 and 34 engage the rollers 42 and 44 which places the springs in a state, or increased state, of tension as the springs are bent over the rollers and elongated as shown in FIG. 4 particularly as the gate 12 is pivoted further rearwardly into a substantially vertical position thereby opening the gate. Upon occupying such vertical position, the weight of the gate 12 produces a downwardly acting force on the gate indicated by arrow 50 in FIG. 4 which is substantially counter balanced by the upwardly acting tension produced force indicated by the arrow 52 which is applied to the gate 12 by the springs 42 and 44 being placed in a state of tension by the rollers 42 and 44. The upwardly acting tension produced force 52 is the upwardly acting vertical component of the tension produced force 54 applied directly to the lower gate portion 14 by the tension springs 42 and 44. By mounting the rollers 42 and 44 on the leaf springs 45 and 46, smoothness of operation is provided to the application of tension produced force to the gate 12 by the springs and a resilient or shocked absorber effect is provided to cushion the positioning of the gate in the spring balanced generally vertical open position shown in FIG. 4. With the gate spring balanced in the vertical position shown in FIG. 4, it will be understood that a gate operator or attendant may manually apply a very small force to the gate 12 to pivot the gate in the forward direction as indicated by the arrow 20 in FIG. 1 to move the gate from its open position shown in FIG. 4 to its closed position shown in solid outline in FIG. 2. It will be understood that the end of the gate 12 may be provided with a suitable pivotally mounted stop member (not shown) which is pivoted downwardly by the force of gravity to provide a stop limit to the forward pivoting of the gate 12. The apparatus 10 may be provided with a stop member 55 engageable by the gate 12 to provide the gate with a stop limit to its rearward motion. The stop member 55 is best seen in FIG. 3.

Figure 5:
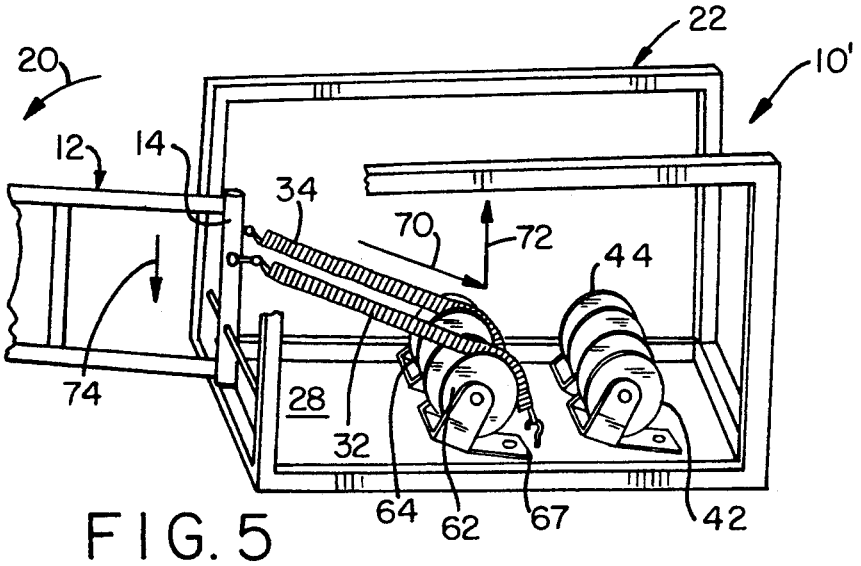
FIG. 5 is an alternate embodiment of the spring gate of the present invention showing the gate pivoted forward into its closed position with portions of the frame broken away for ease of illustration.

Referring now to FIG. 5 and to the further embodiment of the spring gate apparatus of the present invention, the structural elements shown in FIGS. 2–4 and described above which are the same as the structural elements shown in FIG. 5 are given the same numerical designations for convenience of reference and it will be understood that such elements have the same functions as described above. In the embodiment of FIG. 5, the spring gate apparatus 10' includes a second pair of rollers 62 and 64 mounted to the frame bottom 28 by a pair of spring leaf members, only spring leaf member 67 being shown in FIG. 5. Upon the gate 12 being pivoted in the forward direction as indicated by the arrow 20, the rollers 62 and 64 engage the springs 32 and 34 as the springs are bent over the rollers to place the springs in tension, or in an increased state of tension, causing the springs to apply tension produced force indicated by the arrow 70 in FIG. 5. It will be understood that the tension produced force 70 applied to the gate rearward portion 14 has a vertically upwardly acting tension produced force component indicated by the arrows 72 which substantially counter balances the downwardly acting force applied to the gate 12 due to its weight and indicated in FIG. 5 by arrow 74. It will be understood that the gate 12 is spring balanced in a generally horizontal closed position and the gate attendant or operator may manually apply a small upwardly acting force to the gate 12 to pivot the gate from its closed position shown in FIG. 5 to its open position shown in FIG. 4.

Figure 6:
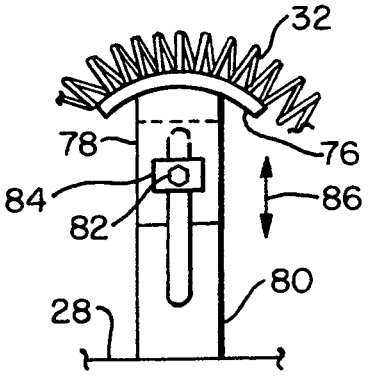
FIG. 6 is a diagrammatical illustration, in partial view, of a further embodiment of the present invention wherein the means for engaging the springs to place the springs in tension are variable means whereby the springs may be placed in varying amounts of tension so as to provide varying amounts of tension produced force to the gate.

Referring to the further embodiment illustrated partially in FIG. 6, it will be understood that the rollers 32 and 34 and 62 and 64 each may be replaced by a curved member 76 mounted suitably fixedly to the top of a top mounting member 78 which cooperates with the bottom mounting member 80 mounted fixedly to the frame base 28 to permit the height of the spring engaging member 76 to be varied. The top mounting member 78 is slidable with respect to the bottom mounting member 80 with both members having slots formed therein as shown in FIG. 6 which receive a bolt 82 which may be used to place the upper and lower mounting members 78 and 80 in a fixed relationship through the mounting plate 82. The upper mounting member 78 may be raised or lowered with respect to the lower mounting member 80 as indicated by the double headed arrow 86 in FIG. 6 whereby the height of the spring engaging member 76 may be varied. Varying the height of the spring engaging member 76 causes the springs 32 and 34 and 62 and 64, only representative spring 32 being shown in FIG. 6, to be placed in different amounts of tension whereby the springs may apply different amounts of tension produced force to the gate 12.

It will be understood that many variations and modifications may be made in the present invention without departing from the spirit and the scope thereof.

What is claimed is:

1. Improved gate apparatus, comprising:

a gate mounted pivotally for being pivoted in the forward direction to close said gate and for being pivoted in the rearward direction to open said gate;

at least one coiled tension spring connected to said gate;

first spring engaging means including at least one first curved surface for engaging said spring upon said gate being pivoted in said forward direction to place said spring in tension and to cause said spring to apply first tension force to said gate to cause said gate to be spring balanced in a generally horizontal closed position to close said gate;

second spring engaging means including at least one second curved surface for engaging said spring upon said gate being pivoted in said rearward direction to place said spring in tension and to cause said spring to apply second tension produced force to said gate to cause said gate to be spring balanced in a generally vertical position to open said gate.

2. The gate according to claim 1 wherein said at least one coiled tension spring includes a pair of coiled tension springs connected to said gate, wherein said first spring engaging means includes a pair of first spring engaging means including a pair of first curved surfaces for engaging said pair of coiled tension springs and wherein said second spring engaging means includes a pair of second spring engaging means including a pair of second curved surfaces for engaging said pair of coiled tension springs.

3. The gate apparatus according to claim 2 wherein said spring engaging means may be varied in height to place said tension spring into different amounts of tension to apply different amounts of tension produced force to said gate.

4. The gate apparatus according to claim 1 or 2 wherein said apparatus further comprises base means, wherein said gate includes a rearward portion mounted pivotally to said base means and wherein said at least one coiled tension spring extends between said base means and said rearward portion of said gate.

5. The gate apparatus according to claim 4 wherein said at least one coiled tension spring includes at least two coiled tension springs extending between said base means and said rearward portion of said gate.

6. The gate apparatus according to claim 1 wherein said first and said second spring engaging means may be varied in height to place said tension spring in different amounts of tension to apply different amounts of tension to said spring.

7. Improved gate apparatus, comprising:

a gate mounted pivotally for being pivoted in the forward direction to close said gate;

at least one coiled tension spring connected to said gate;

spring engaging means including a curved surface for engaging said spring upon said gate being pivoted in the forward direction to place said spring in tension and to cause said spring to apply tension force to said gate to cause said gate to be spring balanced in a generally horizontal position to close said gate.

8. The gate according to claim 7 wherein said at least one coiled tension spring includes a pair of coiled tension springs connected to said gate and wherein said spring engaging means include a pair of spring engaging means providing a pair of curved surfaces for engaging said pair of coiled tension springs.

* * * * *